US012624567B2

(12) United States Patent
Neusch

(10) Patent No.: US 12,624,567 B2
(45) Date of Patent: May 12, 2026

(54) PALISADE FENCE

(71) Applicant: Neusch Innovations, LP, Burnet, TX (US)

(72) Inventor: William H. Neusch, Marble Falls, TX (US)

(73) Assignee: Neusch Innovations, LP, Burnet, TX (US)

( * ) Notice: Subject to any disclaimer, the term of this patent is extended or adjusted under 35 U.S.C. 154(b) by 276 days.

(21) Appl. No.: 18/590,663

(22) Filed: Feb. 28, 2024

(65) Prior Publication Data

US 2024/0287831 A1 Aug. 29, 2024

Related U.S. Application Data

(60) Provisional application No. 63/448,989, filed on Feb. 28, 2023.

(51) Int. Cl.
*E04H 17/00* (2006.01)
*E04H 17/14* (2006.01)

(52) U.S. Cl.
CPC ..... *E04H 17/003* (2013.01); *E04H 17/143* (2013.01); *E04H 17/146* (2021.01); *E04H 17/1488* (2021.01)

(58) Field of Classification Search
CPC ..... E04H 17/1417; E04H 17/1426; E04H 17/143; E04H 17/1447; E04H 17/146; E04H 17/1488
See application file for complete search history.

(56) References Cited

U.S. PATENT DOCUMENTS

| | | | | |
|---|---|---|---|---|
| 2,520,313 | A * | 8/1950 | Harris | E04H 17/1447 256/22 |
| 7,134,646 | B1 * | 11/2006 | Brooks | E04H 17/143 256/65.12 |
| 7,475,868 | B1 * | 1/2009 | Gibbs | E01F 15/06 256/34 |
| 9,863,106 | B2 * | 1/2018 | Conway | E01F 15/0423 |
| 10,577,825 | B1 * | 3/2020 | Givens | E04H 17/1456 |
| 2005/0056821 | A1 | 3/2005 | Kerr | |
| 2007/0221902 | A1 | 9/2007 | Kerr | |
| 2008/0265228 | A1 | 10/2008 | Bosman | |
| 2011/0278525 | A1 * | 11/2011 | Dale | E04H 17/1447 256/65.01 |
| 2022/0145660 | A1 | 5/2022 | Castellucci | |
| 2023/0123821 | A1 * | 4/2023 | Messelis | E04H 17/1439 256/24 |

FOREIGN PATENT DOCUMENTS

| | | | | |
|---|---|---|---|---|
| FR | 2957376 A1 * | 9/2011 | | E04H 17/1413 |
| GB | 2241721 A * | 9/1991 | | E04H 17/143 |

* cited by examiner

*Primary Examiner* — Michael P Ferguson
(74) *Attorney, Agent, or Firm* — BRADLEY ARANT BOULT CUMMINGS LLP

(57) ABSTRACT

A palisade fence includes a first post spaced laterally from a second post, the first post and the second post each having a front face, a channel rail having a first terminal end fastened to the first post and a second terminal end fastened to the second post, the channel rail having a front wall, legs, returns and a slot formed between the returns opposite from the front wall, an inner plate disposed inside of the channel rail at the second terminal end, a fastener attached to the inner plate and the second post, and a plurality of pails vertically secured to the front wall.

12 Claims, 4 Drawing Sheets

PALISADE FENCE

TECHNICAL FIELD

This disclosure relates in general to the field of fencing, and more particularly, but not by way of limitation, to a palisade security fencing.

BACKGROUND

This section provides background information to facilitate a better understanding of the various aspects of the disclosure and is not an admission of prior art.

Palisade fences are commonly used as security fences to prevent access to an area by unauthorized persons. Palisade fences are commonly constructed of steel with each section having spaced apart posts joined by two or more horizontal rails to which pales are attached. The rails are commonly angle-iron or L-shaped members that are secured to the side or front face of the posts.

SUMMARY

An exemplary palisade fence includes a first post spaced laterally from a second post, the first post and the second post each having a front face, a channel rail having a first terminal end fastened to the first post and a second terminal end fastened to the second post, the channel rail having a front wall, legs, returns and a slot formed between the returns opposite from the front wall, an inner plate disposed inside of the channel rail at the second terminal end, a fastener attached to the inner plate and the second post, and a plurality of pails vertically secured to the front wall.

Another exemplary palisade fence includes a first post, a second post, and a third post each having a front face, a first channel rail having a first terminal end fastened to the first post and a second terminal end fastened to the second post, a second channel rail coaxial with the first channel rail and having a third terminal end fastened to the second post and a fourth terminal end fastened to the third post, the first channel rail and the second channel rail each have a front wall, legs, returns, and a slot formed between the returns opposite from the front wall, the third terminal end generally abutting the second terminal end at the front face of the second post, an inner plate disposed inside of the first channel rail at the second terminal end and inside of the second channel rail at the third terminal end, an outer plate between the front face of the second post and the returns of the first channel rail and the second channel rail, a first fastener attached to the inner plate, the outer plate, and the second post, a second fastener attached to the inner plate, the outer plate and the second post. and a plurality of pails vertically secured to the front wall.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. As will be understood by those skilled in the art with the benefit of this disclosure, elements and arrangements of the various figures can be used together and in configurations not specifically illustrated without departing from the scope of this disclosure.

DETAILED DESCRIPTION

Figure 1:
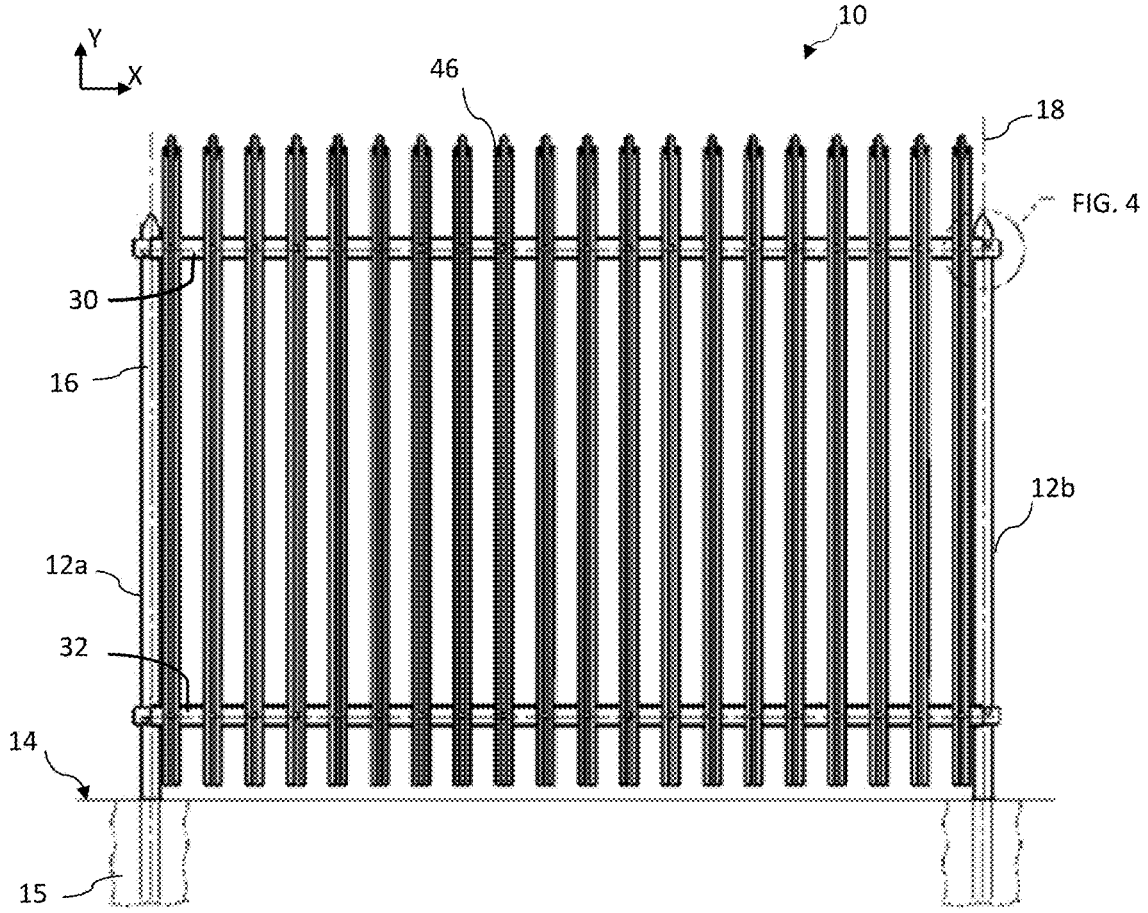
FIG. 1 is a front elevation view of a section of an exemplary palisade fence according to one or more aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Figure 2:
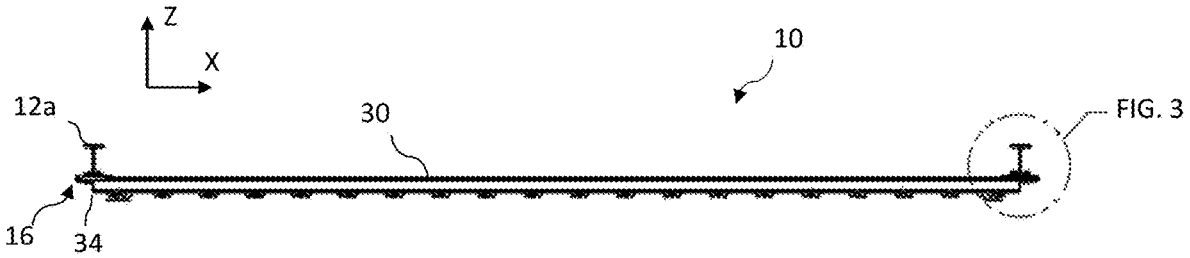
FIG. 2 is a plan view of the exemplary section of FIG. 1.
Figure 5:
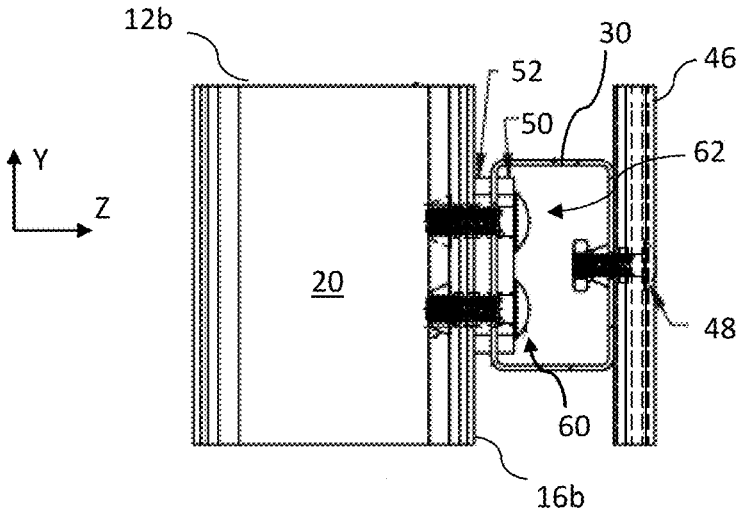
FIG. 5 is a view of an exemplary connection of a horizontal rail and post along the line V-V in FIG. 4 according to one or more aspects of the disclosure.

FIGS. 1, 2, and 5 depict three mutual orthogonal directions X, Y, Z forming a three-dimensional frame of reference. A longitudinal, or lateral, axis X is generally horizontal or parallel to a ground level and extends along the length of a fence. A vertical axis Y. An X-Y plane is considered to be a vertical plane, and a transverse axis Z is orthogonal to the X-Y plane.

Figure 6:
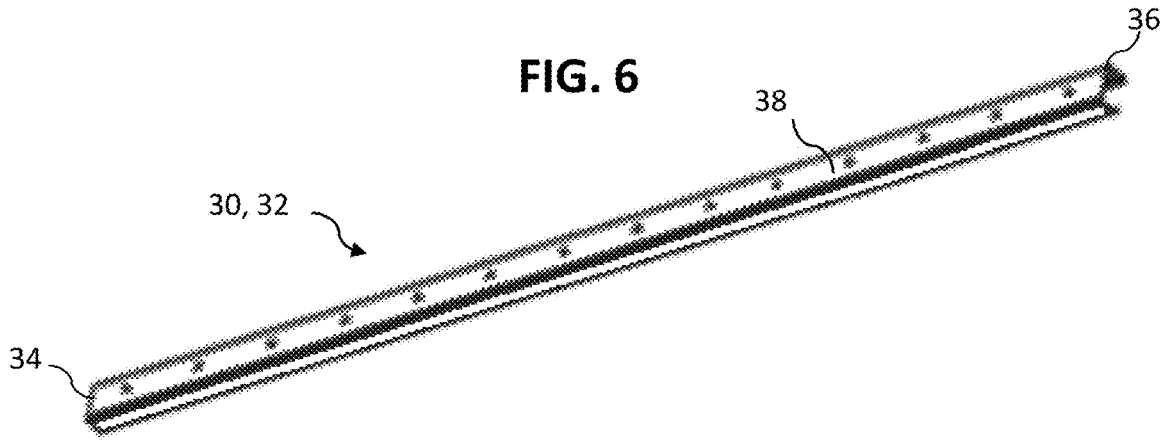
FIG. 6 is a perspective view of a channel rail according to one or more aspects of the disclosure.

FIGS. 1 and 2 illustrate an single section of fence that is representative of an exemplary palisade fence, generally designated with the numeral 10. FIG. 6 illustrates an exemplary palisade fence 10 with adjacent sections of fence. In general, palisade fences 10 are constructed of metal such as steel.

With reference to the figures, palisade fence 10 includes posts generally represented by the numeral 12 and individually identified as first post 12*a*, second post 12*b*, third post 12*c*. etc. Posts 12 are spaced laterally from one another, and the lower ends are secured below ground level 14 in concrete 15. Each post 12 has a front face 16 and a central vertical axis 18.

Figure 3:
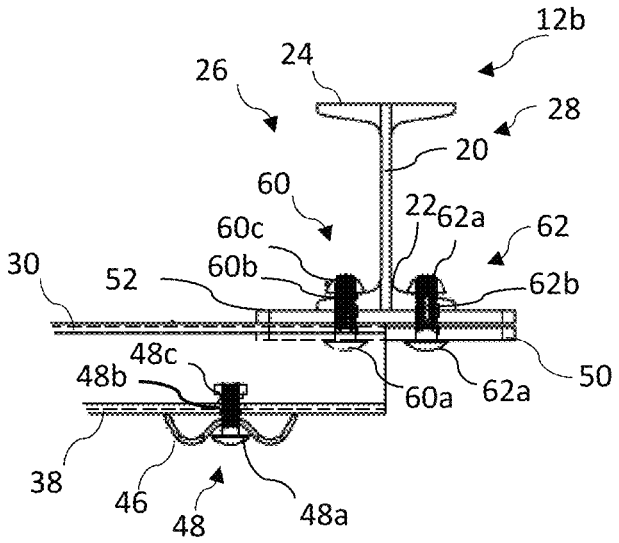
FIG. 3 is a plan detail view of an exemplary connection of a horizontal rail to a post of FIG. 2 according to one or more aspects of the disclosure.
Figure 4:
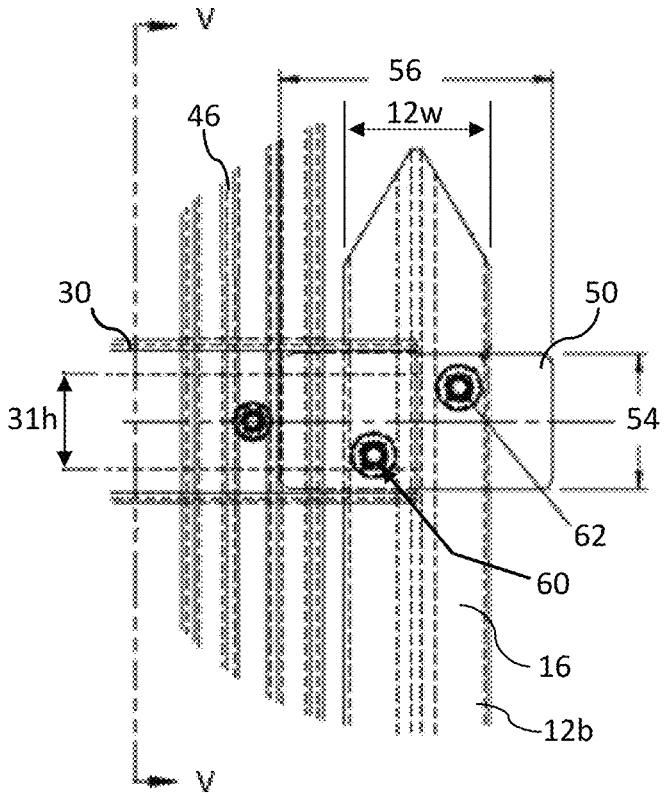
FIG. 4 is an elevation detail view of an exemplary connection of a horizontal rail and post of FIG. 1 according to one or more aspects of the disclosure.
Figure 10:
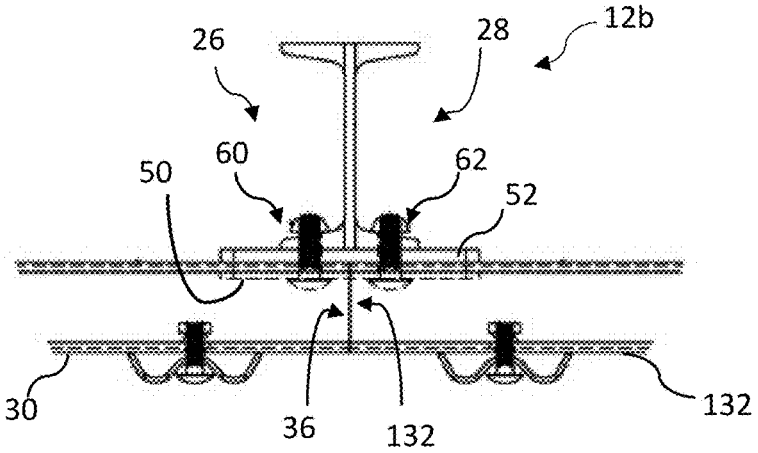
FIG. 10 is a is a plan detail view of an exemplary connection of adjacent horizontal rail to a common post of FIG. 9 according to one or more aspects of the disclosure.

Posts 12 may be constructed of flanged beams as illustrated for example in FIGS. 3 and 10. Flanged beams 12 include a web 20 that extends orthogonal to a first or front flange 22 and a second or aft flange 24 and separates a first side 26 from a second side 28 of the post. Web 20 is parallel to the Y-Z vertical plane and orthogonal to longitudinal or lateral axis X of the fence. For purposes of description, first or front flange 22 forms front face 16.

Palisade fence 10 includes rails that extend laterally between adjacent posts. Each section of fence may include two or more vertically separated rails. In the illustrated examples, palisade fence includes upper rails 30 and lower rails 32. Upper rails 30 and lower rails 32 may be constructed of the same material and may be attached to the posts in the same or similar manners. Exemplary rails and rail-to-post connections are described with reference to representative upper rails 30.

Figure 7:
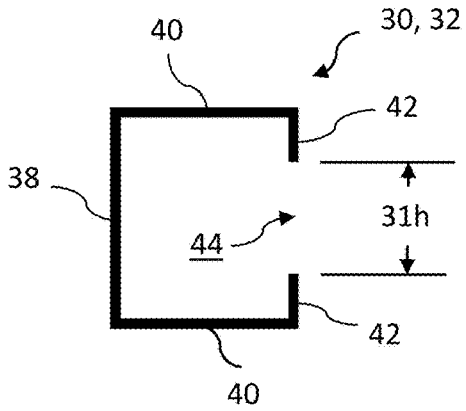
FIG. 7 is an end view of an exemplary channel rail according to one or more aspects of the disclosure.

With reference in particular to FIGS. 1-7 and 9-10, a first top rail 30 has a first terminal end 34 fastened to first post 12*a* and a second terminal end 36 fastened to second post 12*b*. FIGS. 6 and 7 illustrate representative channel rails 30. 32 with a front wall 38, legs 40, returns 42, and a slot 44.

A plurality of pails 46 are vertically secured to front wall 38 of the rails. Pails 46 are metal, for example, steel members and can be in various shapes and configurations. Pails 46 are connected to the rails with a pail fastener 48, e.g., welding, bolts, rivets, screws, and the like. With reference to FIGS. 3 and 5, an exemplary pail fastener 48 has a head 48*a* (security head) and a shaft 48*b* that penetrates pail 46 and front wall 38, and a nut 48*c*, such as a breakaway nut, is secured to shaft 48*b* inside of the rail.

The connection of representative rail 30 to second post 12*b* includes one or more plates. The illustrated examples include an inner plate 50 and an outer plate 52. It is contemplated that a single plate, e.g., an inner plate 50 may be utilized. In an exemplary embodiment, inner plate 50 and outer plate 52 are identical, or near identical members.

Figure 8:
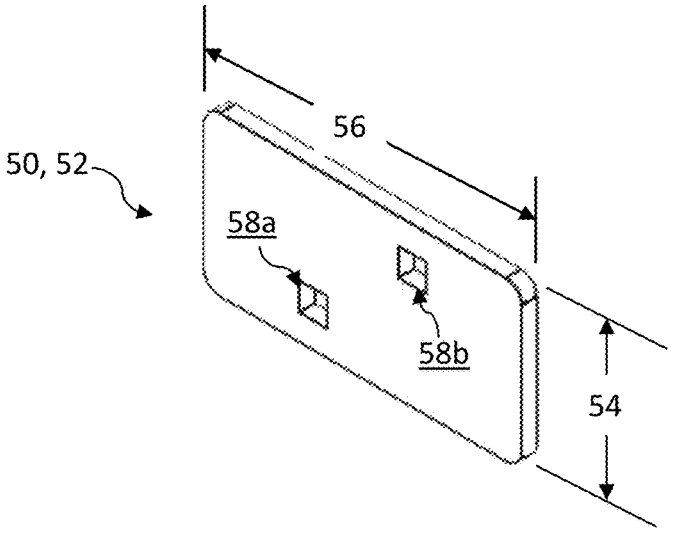
FIG. 8 is a perspective view of an exemplary plate for connecting the rails and posts according to one or more aspects of the disclosure.

FIG. 8 is a perspective view of an exemplary inner plate 50 and outer plate 52. Plates 50, 52 have a vertical height 54 and a lateral width 56. In accordance with embodiments, vertical height 54 is greater than the height 31*h* (FIGS. 4, 7) of slot 44 of channel rail 30 and lateral width 56 is greater than the width 12*w* (FIG. 4) of front face 16 of the posts. In use, inner and outer plates 50, 52 may overlap both sides of the post as illustrated for example in FIGS. 3, 4, and 10. Illustrated plates 50, 52 include two apertures 58*a*, 58*b* that are vertically and laterally separated and those apertures 58*a*, 58*b* are not in the same vertical or horizontal plane. Exemplary apertures 58*a*, 58*b* are square for locating a square neck fastener (e.g., bolt) and secure the fastener from rotating.

Inner plate 50 is disposed inside of rail 30 at second terminal end 36. As illustrated in FIGS. 1, 3, 6 and 10 a portion of inner plate 50 extends outside of rail 30. A fastener 60 is attached to inner plate 50 and second post 12*b* to secure the rail to the post. Fastener 60 can take various configurations. In the illustrated embodiments, fastener is a bolt, such as a carriage bolt. Fastener 60 has a terminal head 60*a*, shaft 60*b*, and may include a nut 60*c*. Terminal head 60*a* may be located inside of the rail between the front wall and the inner plate, shaft 60*b* penetrates inner plate 50 for example via aperture 58*a* and post 12*b*, e.g., through the front face. Nut 60*c*, e.g., a tamper resistant breakaway nut, can be secured to shaft 60*b* between the front flange and the second flange. Shaft 60*b* may extend through slot 44 of the rail.

A second fastener 62, may also attach the inner plate to the post in a similar manner as first fastener 60. For example, with reference in particular to FIGS. 3, 4, 5, and 10, second fastener 62 has a head 62*a* located outside of first rail 30 and penetrates with shaft 62*b* inner plate 50, outer plate 52 when it is used, and the front face of the post. A nut 62*c* is secured to shaft 62*b* between the front and aft flanges. One fastener 60, 62 is located on the first side of the flanged beam and the other one of the fasteners is located on the second side of the flanged beam. As illustrated for example by apertures 58*a*, 58*b* (FIG. 8) fasteners 60, 62 are not in the same horizontal or vertical plane when attached to the post.

Palisade fence 10 may utilize an outer plate 52. Outer plate 52 is located between the front face 16 of the post and the returns of the channel rail. Outer plate 52 is located exterior of the rail(s). As illustrated, inner plate 50 and outer plate 52 are aligned back-to-back wherein the form a single footprint. The fasteners attached outer plate 52 to the post in the same manner as attaching the inner plate to the post.

Figure 9:
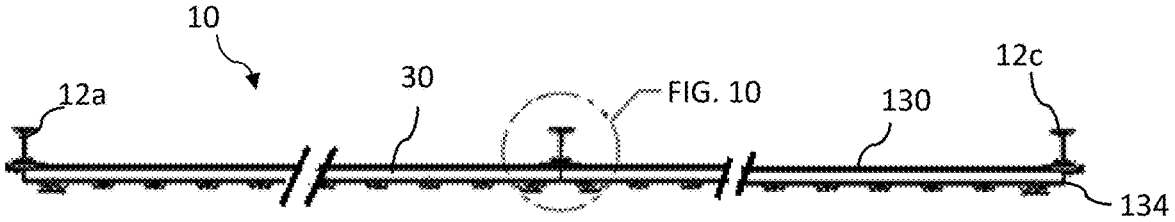
FIG. 9 is a plan view of adjacent sections of a palisade fence with terminal ends of adjacent rails in abutment and secured to a common post.

FIGS. 9 and 10 illustrate the positioning of coaxial adjacent rails 30, 130 and the connection of the coaxial adjacent rails to a common post 12*b*. First rail 30 and first and second posts 12*a*, 12*b* correspond to the fence illustrated in FIGS. 1 and 2. A second rail 130 is arranged coaxially with first rail 130. Second rail 130 has a terminal end 132 generally abuts terminal end 36 of first rail 30. It is desired for the terminal ends to be in direct contact, however, in practice there may be a gap and therefore be in general abutment. The second terminal end 134 of second rail 130 is fastened to a third post 12*c*.

With reference in particular to FIG. 10, first fastener 60 attaches inner plate 50, outer plate 52, and post 12*b* together and consequently secures first rail 30 to the post. Fastener 60 is located on a first side 26 of web 20 of post 12*b*. Second fastener 62 is located on second side 28 of post 12*b* and attaches second rail 130 to post 12*b* via inner plate 50 and outer plate 52. First fastener 60 may extend through the slot of first channel rail 30 and second fastener 62 may extend through the slot of the second channel rail 130.

Although relative terms such as "outer," "inner," "upper," "lower," and similar terms have been used herein to describe a spatial relationship of one element to another, it is understood that these terms are intended to encompass different orientations of the various elements and components in addition to the orientation depicted in the figures. Furthermore, as used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. The terms "substantially," "approximately," "generally," and "about" are defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A palisade fence comprising:

a first post spaced laterally from a second post, the first post and the second post each having a front face, wherein the second post is a flanged beam having a web orthogonal to a first flange and a second flange, and the first flange comprises the front face;

a channel rail having a first terminal end fastened to the first post and a second terminal end fastened to the second post, the channel rail having a front wall, legs, returns and a slot formed between the returns opposite from the front wall;

an inner plate disposed inside of the channel rail at the second terminal end, wherein the inner plate has a vertical height greater than a height of the slot and a lateral width greater than a width of the front face of the second post and the inner plate overlaps both sides of the front face of the second post;

a fastener attached to the inner plate and the second post; and a plurality of pails vertically secured to the front wall.

2. The palisade fence of claim 1, wherein the fastener extends through the slot in the channel rail and the fastener penetrates the inner plate and the front face of the second post.

3. The palisade fence of claim 1, wherein:

the fastener comprises a terminal head located inside of the channel rail between the front wall and the inner plate;

the fastener extends through the slot in the channel rail; and the fastener penetrates the inner plate and the front face of the second post.

4. The palisade fence of claim 1, wherein:

the fastener comprises a terminal head located inside of the channel rail between the front wall and the inner plate;

the fastener extends through the slot in the channel rail;

the fastener penetrates the inner plate and the first flange; and a nut attached to the fastener between the first flange and the second flange.

5. The palisade fence of claim 1, further comprising an outer plate positioned between the front face of the second post and the returns, wherein the fastener penetrates the inner plate and the outer plate.

6. A palisade fence comprising:

a first post spaced laterally from a second post, the first post and the second post each having a front face;

a channel rail having a first terminal end fastened to the first post and a second terminal end fastened to the second post, the channel rail having a front wall, legs, returns and a slot formed between the returns opposite from the front wall;

an inner plate disposed inside of the channel rail at the second terminal end, wherein the inner plate has a vertical height greater than a height of the slot and a lateral width greater than a width of the front face of the second post and the inner plate overlaps both sides of the front face of the second post:

a fastener attached to the inner plate and the second post;

a plurality of pails vertically secured to the front wall; and an outer plate positioned between the front face of the second post and the returns, wherein the fastener penetrates the inner plate and the outer plate.

7. The palisade fence of claim 4, wherein the fastener comprises a terminal head located inside of the channel rail between the front wall and the inner plate, and the fastener extends through the slot.

8. The palisade fence of claim 6, wherein the second terminal end is located at or proximate to a central vertical axis of the second post.

9. A palisade fence comprising:

a first post, a second post, and a third post each having a front face;

a first channel rail having a first terminal end fastened to the first post and a second terminal end fastened to the second post;

a second channel rail coaxial with the first channel rail and having a third terminal end fastened to the second post and a fourth terminal end fastened to the third post, wherein the first channel rail and the second channel rail each have a front wall, legs, returns, and a slot formed between the returns opposite from the front wall;

the third terminal end generally abutting the second terminal end at the front face of the second post;

an inner plate disposed inside of the first channel rail at the second terminal end and inside of the second channel rail at the third terminal end;

an outer plate between the front face of the second post and the returns of the first channel rail and the second channel rail;

a first fastener attached to the inner plate, the outer plate, and the second post, wherein the first fastener comprises a terminal head located inside of the first channel rail between the front wall of the first channel rail and the inner plate, wherein the first fastener extends through the slot in the first channel rail and penetrates the inner plate, the outer plate and the front face of the second post;

a second fastener attached to the inner plate, the outer plate and the second post, wherein the second fastener comprises a terminal head located inside of the second channel rail between the front wall of the second channel rail and the inner plate, wherein the second fastener extends through the slot in the second channel rail and penetrates the inner plate, the outer plate and the front face of the outer plate, wherein the first fastener and the second fastener are not in a same horizontal plane or a same vertical plane; and a plurality of pails vertically secured to the front wall of each channel rail.

10. A palisade fence comprising:

a first post, a second post, and a third post each having a front face;

a first channel rail having a first terminal end fastened to the first post and a second terminal end fastened to the second post;

a second channel rail coaxial with the first channel rail and having a third terminal end fastened to the second post and a fourth terminal end fastened to the third post, wherein the first channel rail and the second channel rail each have a front wall, legs, returns, and a slot formed between the returns opposite from the front wall;

the third terminal end generally abutting the second terminal end at the front face of the second post;

an inner plate disposed inside of the first channel rail at the second terminal end and inside of the second channel rail at the third terminal end;

an outer plate between the front face of the second post and the returns of the first channel rail and the second channel rail;

the inner plate and the outer plate each have a vertical height greater than a height of the slot of each channel rail and a lateral width greater than a width of the front face of the second post and the inner plate and the outer plate overlap both sides of the front face of the second post;

a first fastener attached to the inner plate, the outer plate, and the second post;

a second fastener attached to the inner plate, the outer plate and the second post; and a plurality of pails vertically secured to the front wall.

11. The palisade fence of claim 10, wherein:

the first fastener comprises a terminal head located inside of the first channel rail between the front wall of the first channel rail and the inner plate, wherein the first fastener extends through the slot in the first channel rail and penetrates the inner plate and the outer plate; and the second fastener comprises a terminal head located inside of the second channel rail between the front wall of the second channel rail and the inner plate, wherein the second fastener extends through the slot in the second channel rail and penetrates the inner plate and the outer plate.

12. The palisade fence of claim 10, wherein the first fastener and the second fastener are not in a same horizontal plane or a same vertical plane.

* * * * *